United States Patent [19]

Lohn

[11] 4,260,158

[45] Apr. 7, 1981

[54] APPARATUS FOR BOARD GAME

[76] Inventor: Christiaan F. Lohn, 5431 189th St. SW., Lynnwood, Wash. 98036

[21] Appl. No.: 52,674

[22] Filed: Jun. 27, 1979

[51] Int. Cl.[3] ..... A63F 3/00

[52] U.S. Cl. ..... 273/267

[58] Field of Search ..... 273/146 R, 267, 269, 273/271, 274

[56] References Cited

U.S. PATENT DOCUMENTS

| | | | |
|---|---|---|---|
| 1,521,095 | 12/1924 | Harris | 273/271 |
| 1,615,077 | 1/1927 | Gouldin | 273/267 |
| 3,863,926 | 2/1975 | White | 273/267 |

FOREIGN PATENT DOCUMENTS

| | | | |
|---|---|---|---|
| 456477 | 4/1950 | Italy | 273/146 |
| 18341 | of 1899 | United Kingdom | 273/267 |

OTHER PUBLICATIONS

"Shake Bingo", Schaper Toys Catalog.

*Primary Examiner*—Harland S. Skogquist
*Attorney, Agent, or Firm*—Christensen, O'Connor, Johnson & Kindness

[57] ABSTRACT

A board game apparatus includes a pair of dice, each of the dice having a first, second and third indicia marked on the faces thereof. A board is divided into a plurality of object spaces, each of the object spaces having indicia marked thereon corresponding to the indicia marked on the faces of the dice. The ratio between the number of object spaces of each indicia on the board is the same as the ratio of the number of faces of each die having the same indicia. The game apparatus also includes a plurality of marker pieces, the marker pieces being adapted for selective placement on the board so as to surround each object space.

11 Claims, 5 Drawing Figures

APPARATUS FOR BOARD GAME

BACKGROUND OF THE INVENTION

This invention relates to a novel game and apparatus for playing the game, and more particularly relates to apparatus for playing a board game in which the players selectively place pieces on the board so as to encircle certain portions of the board to earn points associated with those portions of the board.

It is an object of the present invention to provide a game and apparatus for playing the game that is both novel and interesting.

It is another object of the present invention to provide an apparatus for playing a board game that is easy and inexpensive to manufacture and that can be used and enjoyed by persons of all ages.

SUMMARY OF THE INVENTION

In accordance with the principles and objects of the present invention a board game and apparatus for playing the game is provided including in combination a board and a pair of dice. Each of the dice have a first, second and third indicia marked on the faces thereof. The board is divided into a plurality of object spaces, each of the object spaces having indicia marked thereon corresponding to the indicia marked on the faces of the dice. The ratio between the number of object spaces of each indicia on the board is the same as the ratio of the number of faces of each die having the same indicia. The game apparatus also includes a plurality of marker pieces, the marker pieces being adapted for selective placement on the board so as to surround each object space on the board.

In a further embodiment of the invention, a plurality of point indicating pieces are provided, the point indicating pieces being adapted for selective placement on the object spaces of the board at the beginning of the game and being removed selectively therefrom by players as they surround the object spaces of the board in accordance with the rules of the game.

BRIEF DESCRIPTION OF THE DRAWINGS

In order that the invention may be more readily understood, a sample game according to the invention and one set of rules for playing such game will now be described by way of example with reference to the accompanying drawings wherein.

DETAILED DESCRIPTION OF THE PREFERRED EMBODIMENT

Figure 1:
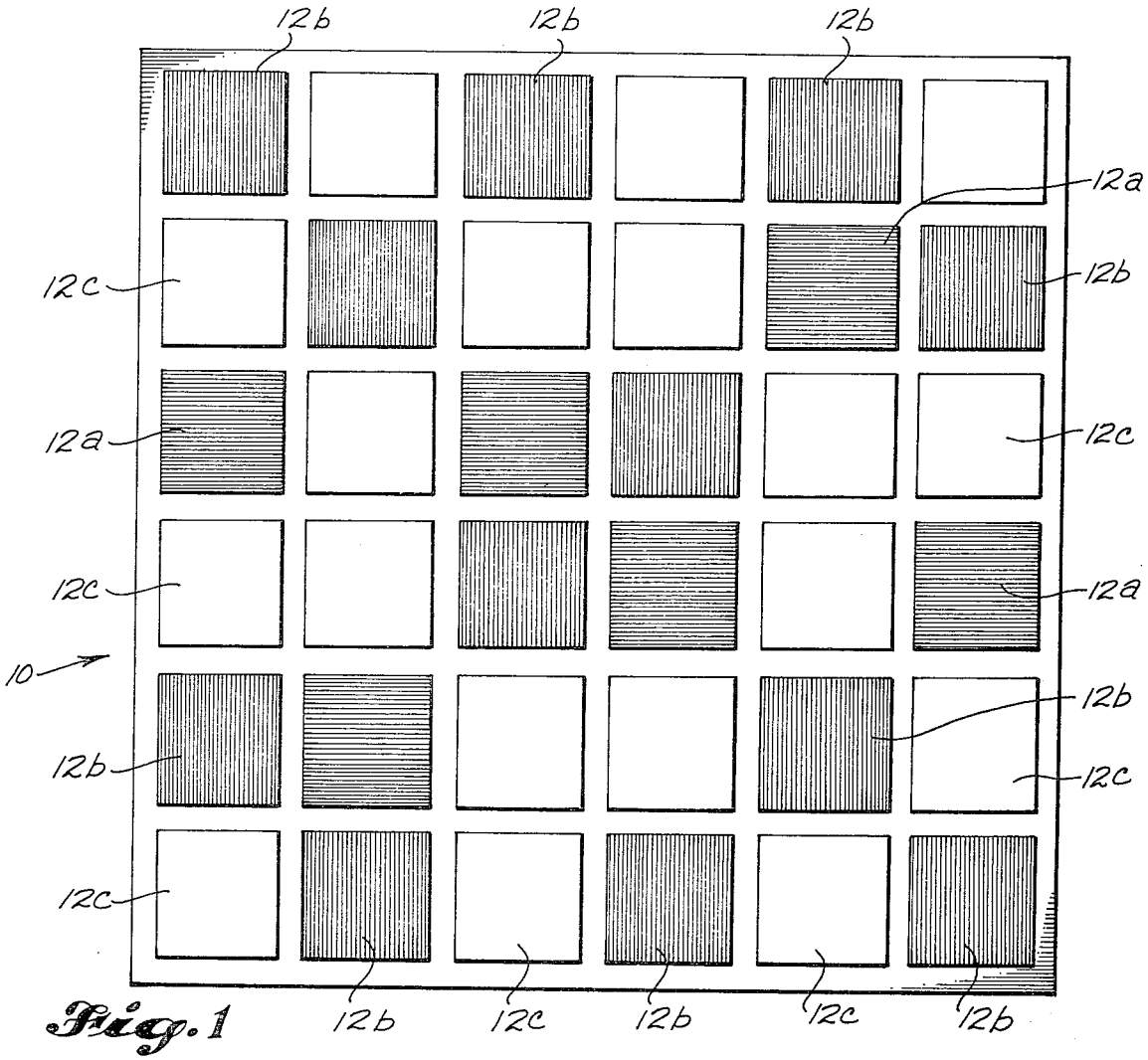
FIG. 1 is a plan view of a board for use in playing the game of the present invention.

The Equipment:

Referring now to FIG. 1, a square board 10 suitable for playing the game of the present invention is divided into thirty-six (36) equal area square object spaces arranged in a six (6) by six (6) array on the board. Each of the squares is spaced from the adjacent squares by a distance smaller than the width of the squares to provide playing locations. The squares which lie on the outer perimeter of the board are spaced from the edge of the board by the same distance as the spacing between the adjacent squares thereby providing additional playing locations. The squares are divided into three groups, the squares of each group being marked with an indicia to identify the squares with their group. In the preferred embodiment, the marking is by color such that the squares 12*a* of the first group are colored blue, the squares 12*b* of the second group are colored red and the squares 12*c* of the third group are colored white. Out of the thirty-six (36) squares on the board, six (6) are colored blue, twelve (12) are colored red and eighteen (18) are colored white.

Figure 2:
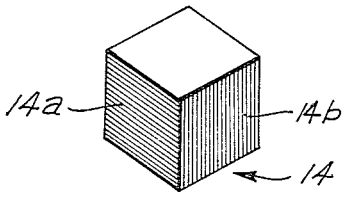
FIG. 2 is a perspective view of a die made in accordance with the principles of the present invention.
Figure 3:
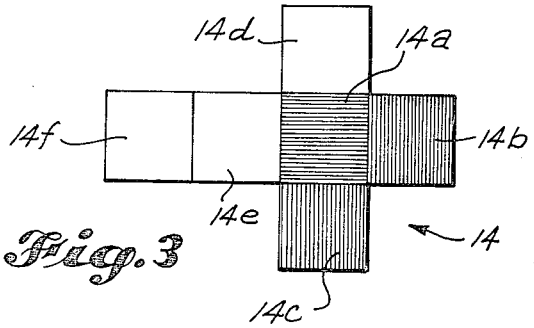
FIG. 3 is a development of the die of FIG. 2 onto a flat surface.

The game apparatus includes a pair of identical dice. One of the dice is pictured in FIG. 2. The die 14 has a first face 14*a* thereof colored blue, a second and third face 14*b* and 14*c* respectively colored red and a fourth, fifth and sixth face 14*d*, 14*e* and 14*f* respectively colored white. This can best be seen in the development of the die 14 onto a flat surface shown in FIG. 3. The second die, not pictured, is identical to the die 14. The faces of the die 14 are colored in the same ratio as the coloring of the squares on the board 10, the ratio of blue to red to white squares being 1:2:3.

Figure 4:
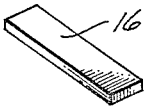
FIG. 4 is a perspective view of a marker piece made in accordance with the present invention.

The remaining equipment, which comprises the preferred embodiment of the game apparatus of the present invention, includes a plurality of rectangular marker pieces 16, one of which is shown in FIG. 4, having a width equal to or slightly larger than the spacing between adjacent squares on the board and a length approximately equal to the length of the squares on the board. The number of marker pieces required is equal to the number of spaces between adjacent squares plus the number of spaces on the outer perimeter of the board adjacent the squares arranged around the edge of the board. In the case of the board pictured in FIG. 1 having thirty-six (36) squares in a six (6) by six (6) array, a total of eighty-four (84) marker pieces are needed.

Figure 5:
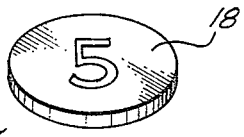
FIG. 5 is a perspective view of a point indicating piece made in accordance with the principles of the present invention.

FIG. 5 illustrates a point indicator piece 18 which is similar to a poker chip and has a numeral thereon indicating a point value. The point indicator pieces 18 are colored to correspond to the coloring of the squares on the board so that there are a total of thirty-six (36) point indicator pieces, six (6) blue, twelve (12) red and eighteen (18) white.

Object of the Game:

The object of the game is to score points by "capturing" the object spaces on the board. The spaces are captured by surrounding the space with the rectangular marker pieces. The player who places the final marker piece necessary to surround the space "captures" that space and is awarded the points associated with that space. Markers are placed on the board in accordance with the rules of the game as set forth below.

The winner of the game may be declared as the player having the most points after all the marker pieces have been placed on the board or alternatively it may be the player who first scores a number of points sufficient to make it impossible for any other player to capture enough remaining spaces to obtain a higher point total.

The Play:

The following description applies to the game when played by two players and it will be appreciated that the rules will vary if more players are to play. To start the game each player throws the dice to determine which player will make the first play of the game. The player throwing the highest combination on the dice makes the first play. The combinations are arranged in priority in accordance with the odds of throwing the combination. The highest ranking combination is a blue-blue, the second highest is red-red followed by blue-red, blue-white, white-white, and white-red. When the starting player has been determined, he makes the first play and the play progresses clockwise thereafter.

The first player, identified as player A for purposes of this description, throws the dice and observes the color combination which he has thrown. Player A can then place a marker on the board in any playing location that lies between squares matching the color combination thrown. For example, if a blue-white is thrown with the dice, a marker can be placed on the board between any two adjacent white and blue squares. After player A has placed his marker, the second player, player B, throws the dice and places a marker on the board in accordance with the color combination that he has thrown. In order for a player to place a marker on any of the playing locations lying on the outer perimeter of the board the player must throw a double color combination, for example, a red-red, blue-blue or white-white corresponding to the adjacent square. If a color combination is thrown for which no corresponding space is available on the board the player may place a marker piece on any available space of his choosing. Whenever any player throws a double blue, or double red combination, that player earns another turn subject to the limitation described below. Play progresses from player to player until a marker piece placed along side a square completes the capture of a square, that is, until marker pieces have been placed upon all four sides of the square. The player placing the final marker that surrounds the square captures that square and earns a certain number of points corresponding to that square. For example, in the preferred embodiment of the game, the white squares are worth five points, there being more white squares than any other color, the red squares are worth 10 points and the blue squares are worth 25 points, there being fewer blue squares on the board than any other color.

When a player captures a square, besides earning the points for that corresponding square, the player also earns another turn. However, only one extra turn is given for any one play. Therefore, even if the square was captured by throwing a double color combination, which would ordinarily have already earned the player an extra turn, only one extra turn is given rather than two extra turns. The same is true for the situation in which a player captures two squares by the placement of a single marker piece, only one extra turn is awarded.

Play ends when all the squares on the board are surrounded or captured or when the point total of any one player exceeds the possible point total of any of the other players including all of the uncaptured squares remaining on the board. If desired, points may be accumulated over a series of several games to determine an over-all winner.

In the simplest form of the game, the players can keep track of the squares captured by each player by marking that fact on a score pad or sheet of paper. In the preferred embodiment of the game, the point value chips are placed on the squares prior to the beginning of the game and as each square is captured, the player capturing the square removes the chip from the square and places it in a pile before him. Then at the end of the game the point values of the chips gathered by each player can be easily totaled to determine the winner of the game. In a variation of the game, the point value markers, rather than being placed on their corresponding squares, for example, the red markers on the red squares, the white markers on the white squares and the blue markers on the blue squares, can be distributed randomly on the board thereby changing the strategy of the game since it may not always be true that the colored squares that are fewest in number have the highest point value since in this variation a blue 25-point chip could be placed on a white square.

While a preferred set of rules to play the game in accordance with the present invention and a preferred embodiment of the equipment to play the game according to those rules has been described and illustrated it will be apparent to those of ordinary skill in the art and others that several modifications can be made to the equipment while remaining within the scope of the present invention. The critical features of the invention are that the number of differently marked squares on the board have the same proportion to one another as the marked faces on the dice. In the illustrated embodiment, the ratio of blue squares to red squares to white squares is 1:2:3 which is the identical ratio that the blue face of each die has to the red faces of the die and to the white faces of the die, that is, 1:2:3.

Further, in the illustrated embodiment, the placement of the various squares on the board is arranged so that the eighty-four (84) possible playing locations in which a marker can be placed are arranged substantially in correspondence to the probability of throwing the color combination that allows the player to place a marker in that playing location out of eighty-four (84) possible throws (84 being the total number of playing locations available on the board) that is,:

$M_i = P_i \times M$ where $i = 1,2, \ldots N$; $N$ = total number of color combinations available $M$ = total number of playing locations $M_i$ = number of playing locations corresponding to a particular color combination $P_i$ = probability of throwing a particular color combination For example, the probability of throwing a blue-blue combination on the dice is one out of thirty-six (1/36). Given a total number of eighty-four (84) throws, the probable number of blue-blue combinations which would show up mathematically comes out to be two and one-third ($1/36 \times 84 = 2\frac{1}{3}$). The squares are arranged so that the actual number of blue-blue spaces on the playing board is two. As another example, the mathematical probability of throwing a blue-red or red-red combination is one out of nine (1/9) and the probable number of times a blue-red or red-red combination will come up out of eighty-four (84) throws is nine and one-third ($1/9 \times 84 = 9\frac{1}{3}$). The squares are arranged on the board so that the actual number of blue-red spaces is eight (8) and the actual number of red-red spaces is ten (10). The same relationship is true of the white-blue, white-white and white-red spaces on the board. Since the probable numbers are not always integers, that is, there are fractional amounts, it is necessary to make some adjustments in the numbers of actual spaces of any color on the board since fractional spaces are not possible. However, an attempt is made to match as closely as possible the probable and actual numbers of spaces by arranging the squares as illustrated. It has been found that the actual number of playing locations corresponding to a particular color combination can always be made to be equal to the probable number of playing locations as described above plus or minus two, that is, $$M_i = (P_i \times M) \pm 2$$

It would be possible to arrange the squares in other than the arrangement illustrated in FIG. 1 and still maintain the approximate correlation between actual and probable playing locations out of eighty-four (84) as described above. However, in order to make the game more appealing to the eye the squares on the illustrated board have been arranged to achieve point symmetry about the center of the gameboard.

While the illustrated game board has thirty-six (36) squares arranged in a six (6) by six (6) array, it would be possible to use any number of squares so long as the ratios between the differently marked squares and the marked faces on the dice was maintained. Further, although in the preferred embodiment the object spaces are marked by the colors red, white and blue, it is possible to use any desired means of marking the spaces such as other colors or legends relating to geographic locations or historical events, etc. While in the illustrated board the object spaces are spaced from one another, the game could be played on a board having the spaces directly adjacent one another with no intervening gaps, much like a checkerboard. The playing locations would then be the lines formed by the adjoining sides of the object spaces.

The embodiments of the invention in which an exclusive property or privilege is claimed are defined as follows:

1. A game apparatus comprising in combination:

a pair of dice, each die having R number of faces thereof marked with a first indicia, S faces thereof marked with a second indicia and T faces thereof marked with a third indicia and $R+S+T=6$;

a board divided into a plurality of object spaces, x of said object spaces being marked with said first indicia, y of said spaces being marked with said second indicia and z of said spaces being marked with said third indicia such that x:y:z::R:S:T; and, a plurality of marker pieces adapted for selective placement on said board along the perimeter of said object spaces so as to surround said object spaces.

2. The game apparatus of claim 1 wherein $R=1$, $S=2$ and $T=3$.

3. The game apparatus of claim 1 or 2 wherein said first indicia is a first color, said second indicia is a second color and said third indicia is a third color.

4. The game apparatus of claim 1 wherein said board is divided into N object spaces and has M playing locations adjacent said object spaces on which said marker pieces can be placed; said playing locations being divided into six (6) groups, corresponding to the six possible indicia combinations that can be thrown on the dice, the number of playing locations in each group conforming substantially to the following equation:

$M_i = P_i \times M$ where $i = 1,2,3,4,5$ or $6$ $M_i$ = Number of playing locations in a given group $P_i$ = Probability of throwing a particular indicia combination on said dice.

5. The game apparatus of claim 4 wherein the number of playing location in each group conforms to the equation:

$$M_i = (P_i \times M) \pm 2$$

6. The game apparatus of claim 1 further including a plurality of point indicator pieces, said point indicator pieces being divided into a first, second and third group, each said point indicator piece having marked thereon a numeral corresponding to a point value associated with said piece, the point markers of said first group having a first numeral marked thereon, the point markers of said second group having a second numeral marked thereon and the point markers of said third group having a third numeral marked thereon, said first, second and third numerals all being different.

7. A game apparatus comprising in combination:

a board divided into a plurality of squares, said squares being divided into a first group, a second group and a third group, the squares of said first group being of a first color, the squares of said second group being of a second color and the squares of said third group being of a third color, the number of squares in said first, second and third groups being such that the ratio between the number of squares in said first, second and third groups is 1:2:3;

a pair of dice, each of said dice having a first face marked in said first color, a second and third face marked in said second color and a fourth, fifth and sixth face marked in said third color:

a plurality of elongate marker pieces adapted for selective placement on said board along the perimeter of said squares so as to surround said squares, said marker pieces having their elongate dimension substantially equal to the width of said squares.

8. The apparatus of claim 7 wherein said squares are arranged in a matrix array having adjacent squares spaced from one another a distance less than or equal to the short dimension of said rectangular marker pieces the spaces between adjacent squares providing playing locations on which said marker pieces are selectively placed, the squares lying on the outer perimeter of said matrix array being spaced from the outer perimeter of said board to establish additional playing locations on which said marker pieces are selectively placed.

9. The apparatus of claim 7 or 8 further including a plurality of point indicator pieces, said point indicator pieces being divided into a first, second and third group, the number of point indicator pieces in said first, second and third group being equal to the number of squares in said first, second and third groups respectively.

10. The apparatus of claim 8 wherein said board contains thirty-six (36) squares, said squares being arranged in a six (6) by six (6) array, six (6) of said squares being of said first color, twelve (12) of said squares being of said second color and eighteen (18) of said squares being of said third color, said board further including eighty-four (84) playing locations.

11. The apparatus of claim 10 wherein said squares are arranged such that two (2) of said playing locations are on the outer perimeter of said board adjacent said first color squares, eight (8) of said playing locations are located between squares of said first color and said second color, ten (10) of said playing locations are located on said outer perimeter of said board adjacent said second color squares, fourteen (14) of said playing locations are located between squares of said third color and said first color, twenty (20) of said playing locations are located on the outer perimeter of said board adjacent squares of said third color and thirty (30) of said playing locations are located between squares of said third color and said second color.

* * * * *